United States Patent [19]

Takikawa

[11] 4,164,908

[45] Aug. 21, 1979

[54] CHAINSTITCH FORMING DEVICE FOR SEWING MACHINES

[75] Inventor: Yujiro Takikawa, Toyota, Japan

[73] Assignee: Aisin Seiki Kabushiki Kaisha, Aichi, Japan

[21] Appl. No.: 870,646

[22] Filed: Jan. 19, 1978

[30] Foreign Application Priority Data

Feb. 1, 1977 [JP] Japan ..... 52-11289[U]

[51] Int. Cl.[2] ..... D05B 1/14

[52] U.S. Cl. ..... 112/168; 112/201

[58] Field of Search ..... 112/168, 181, 201, 53

[56] References Cited

U.S. PATENT DOCUMENTS

| | | | |
|---|---|---|---|
| 2,989,017 | 6/1961 | Taketomi | 112/181 X |
| 3,428,008 | 2/1969 | Casas-Robert | 112/168 |
| 3,602,168 | 8/1971 | Yamashita | 112/168 |
| 3,675,603 | 7/1972 | Yamashita | 112/168 |

*Primary Examiner*—Wm. Carter Reynolds

*Attorney, Agent, or Firm*—Oblon, Fisher, Spivak, McClelland & Maier

[57] ABSTRACT

A chain stitch forming device includes a loop retaining member for holding a thread loop having been released from a beak of a loop taker. The loop retaining member is provided at the under side of a restraining member which serves to prevent rotation of a bobbin case retainer and is operated in accordance with a cam surface which is directly connected to a lower shaft of the sewing machine.

3 Claims, 4 Drawing Figures

CHAINSTITCH FORMING DEVICE FOR SEWING MACHINES

BACKGROUND OF THE INVENTION

1. Field of the Invention

This invention relates generally to home sewing machines and more particularly to a chain stitch forming device for sewing machines.

2. Description of the Prior Art

Conventionally, such as for example U.S. Pat. No. 3,602,168 to Yamashita discloses a chain stitch forming device wherein a loop retaining means 65, 67 is provided at the upper side of a restraining member 49 to hold a thread loop which has been passed through recess 48 or opening 52 defined by the restraining member.

In this type, however, the thread loop released from a seizing beak 40 and passed through the opening 52 has become so small that the retaining means may not surely hold the loop, which might customarily cause skip stitching.

SUMMARY OF THE INVENTION

It is, therefore, an object of the present invention to provide an improved chain stitch forming device obviating the above conventional drawbacks.

According to the present invention, a loop retaining member is provided for holding a larger loop which has just released from a beak of the loop taker.

BRIEF DESCRIPTION OF THE DRAWINGS

Various other objects, features and attendant advantages of the present invention will be more fully appreciated as the same becomes better understood from the following detailed description when considered in connection with the accompanying drawings wherein.

DETAILED DESCRIPTION OF THE PREFERRED EMBODIMENT

Figure 1:
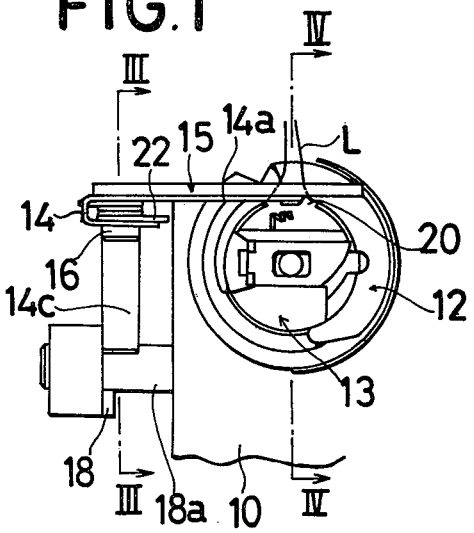
FIG. 1 is a front view of the present invention.
Figure 3:
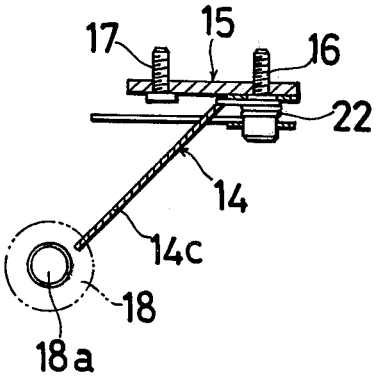
FIG. 3 is a cross-sectional view taken along the line III—III in FIG. 1; and, FIG. 4 is a cross-sectional view taken along the line IV—IV in FIG. 1.

Referring now to the attached drawings, the numeral 10 designates a free arm or a base member of the sewing machine. The device for converting a lock stitch to a chain stitch operation or vice versa is disposed within the base member 10 and includes a loop taker 11 having a shaft portion 11*a* rotatably supported by a lower shaft (not shown), a bobbin case retainer 12 disposed within the loop taker 11 adapted to receive a bobbin case 13 therein, a loop retaining member 14 swingably supported by the base member 10 through a screw bolt 16 and a restraining member 15 rigidly secured to the base member 10 by means of the screw bolt 16 and another screw bolt 17 for restraining rotation of the bobbin case retainer 12 with respect to rotation of the loop taker 11. The device further includes a cam face 18 provided on a shaft 18*a* which is directly connected to one end of the lower shaft and a change lever 19 which is operatively connected to manual means (not shown) provided on an appropriate portion of the machine frame.

The shuttle assembly comprising the loop taker 11, the bobbin case retainer 12, the bobbin case 13 and a bobbin (not shown) shows a so-called full rotation front facing shuttle.

Figure 2:
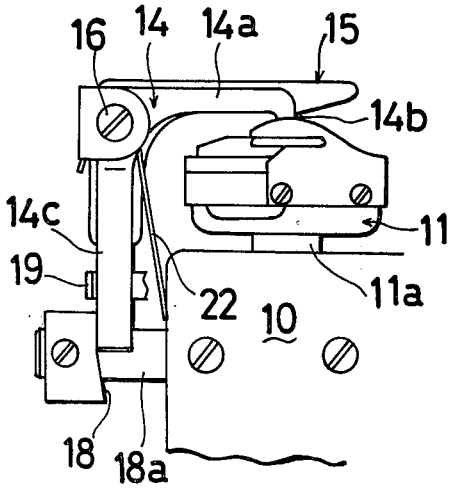
FIG. 2 is an underside view of the present invention.
Figure 4:
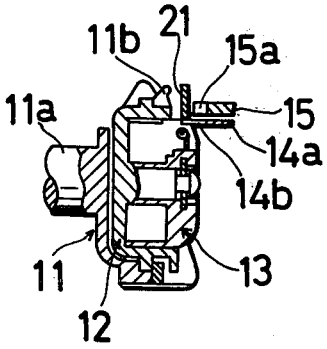

The loop retaining member 14 has a first lever portion 14*a* extending along the underside of the restraining member 15, a loop retainer 14*b* extending inwardly from the free end of the lever portion 14*a* into a gap 20 between a wall 21 of the bobbin case retainer 12 and the bobbin case 13 and a second lever portion 14*c* which is engageable with the cam surface 18. The loop retaining member 14 is always biased to be in contact with the cam surface 18 by a spring 22. The change lever 19 is in engagement with the second lever portion 14*c* of the loop retaining member 14 so that the loop retaining member 14 may be rotated in a counterclockwise direction as viewed in FIG. 2 upon manual operation of the manual means. In this case the second lever portion 14*c* of the loop retaining member 14 is removed from the cam surface 18 and simultaneously the loop retainer 14*b* of the loop retaining member 14 is removed from the cam surface 18 and simultaneously the loop retainer 14*b* of the loop retaining member 14 is removed from the gap 20 between the bobbin case retainer 12 and the bobbin case 13 for preparing for normal lock stitch operation. The loop taker 11 is provided with a loop seizing beak 11*b* for seizing a thread loop of a needle upon rotation. The restraining member 15 has a downward projection 15*a* which is positioned in a groove of the bobbin case 13 for restraining rotation of the latter with respect to the rotation of the loop taker 11.

Referring now to the operation of the invention, a chain stitch forming operation will be first explained.

A thread loop L formed by reciprocation of the needle is seized by the beak 11*b* of the loop taker 11 which rotates in accordance with the reciprocation of the needle. It should be noted that the loop taker 11 is designed to rotate twice each time the needle makes one reciprocation. Accordingly, further rotation of the loop taker 11 will cause the loop L to be released from the beak 11*b*. Then the loop L is taken up by a conventional thread take-up mechanism (not shown) which is mounted on the machine frame for alternately tightening and loosening the needle thread in timed relationship with the vertical reciprocation of the needle.

During the loop being taken up, the second lever portion 14*c* of the loop retaining member 14 is engaged with the cam surface 18 to swing the lever portion 14*c* in accordance with the shape of the cam. Due to such movement of the lever portion 14*c*, the loop retainer 14*b* of the loop retaining member 14 will temporarily hold the loop L which has been released from the beak 11*b* and after the needle passes through the loop L held by the retainer 14*b* the retainer 14*b* is separated from the wall 21 of the bobbin case 13 to release the loop L therefrom. This cycle is repeated to form the desired chain stitch forming operation.

Next referring to a normal lock stitch forming operation, the manual means is first operated to actuate the change lever 19. Due to actuation of the change lever 19 the loop retaining member 14 is rotated about the axis 16 in a counterclockwise direction overcoming the spring 22 as viewed in FIG. 2. Therefore, the second lever portion 14*c* is moved to a position wherein it does not engage with the cam surface 18 and at the same time the loop retainer 14*b* of the loop retaining member 14 is moved to a position wherein it does not exert influence upon the loop formation area. Thus the lock stitch forming operation may be performed by feeding lower or bobbin thread into the bobbin case 13.

Obviously, numerous modifications and variations of the present invention are possible in light of the above teachings. It is therefore understood that within the scope of the appended claims, the invention may by practiced otherwise than as specifically described herein.

What is claimed as new and desired to be secured by Letters Patent of the United States is:

1. A chain stitch forming device for a sewing machine which comprises:

a machine frame;

a needle reciprocably mounted on said machine frame;

a loop taker rotatably mounted on the machine frame and having a loop seizing beak thereon;

a bobbin case retainer disposed in said loop taker adapted to receive a bobbin case therein;

restraining means fixed to the frame for restraining the bobbin case retainer from rotation with said loop taker; and, a loop retaining member swingably supported on the machine frame and including a first lever portion extending along and swingably supported on the under side of said restraining means, a loop retainer extending inwardly from a free end of said first lever portion into a gap provided between said bobbin case retainer and said bobbin case for serving as a guide passage of a thread loop released from said loop seizing beak of said loop taker and a second lever portion engageable with a cam means which is actuated by a lower shaft of the sewing machine, said loop retainer of said loop retaining member being movable to a loop retaining position for temporarily holding the loop having been released from said loop seizing beak to allow the loop held by said loop retainer to be moved off therefrom after the needle passes through the loop.

2. A device according to claim 1 wherein said second lever portion of said loop retaining member is biased by a spring to be in contact with said cam means for actuating said loop retainer of said loop retaining member.

3. A device according to claim 1 wherein a change lever means is further provided for allowing said second lever portion of said retaining member to be disengaged from said cam means thereby to move the loop retainer out of said gap between said bobbin case retainer and said bobbin case.

* * * * *